US006132020A

United States Patent [19]

Schael et al.

[11] Patent Number: 6,132,020

[45] Date of Patent: Oct. 17, 2000

[54] DRAWER SLIDE ASSEMBLY

[75] Inventors: Oliver Schael, Kirchlengern; Eyyahi Dincdemir, Hiddenhausen, both of Germany

[73] Assignee: Paul Hettich GmbH & Co., Kirchlengern, Germany

[21] Appl. No.: 09/294,043

[22] Filed: Apr. 19, 1999

[30] Foreign Application Priority Data

Apr. 29, 1998 [DE] Germany ..... 298 07 540

[51] Int. Cl.[7] ..... A47B 88/00

[52] U.S. Cl. ..... 312/334.1; 312/334.16

[58] Field of Search ..... 312/334.6, 334.11, 312/334.15, 334.16, 334.33, 334.38, 334.31

[56] References Cited

U.S. PATENT DOCUMENTS

| | | | |
|---|---|---|---|
| Re. 25,428 | 7/1963 | Manson | 312/334.38 X |
| 1,045,523 | 11/1912 | Cossey | 312/334.11 X |
| 1,963,220 | 6/1934 | Anderson | 312/334.11 X |
| 2,564,658 | 8/1951 | Jakeway | 312/334.11 X |
| 4,606,588 | 8/1986 | Koch | 312/334.38 X |
| 4,653,821 | 3/1987 | Faust | 312/334.38 X |
| 4,752,143 | 6/1988 | Lautenschlager, Jr. | 312/334.31 X |
| 5,020,869 | 6/1991 | Faust | 312/334.15 X |
| 5,242,221 | 9/1993 | Rotthowe | 312/334.38 |
| 5,472,272 | 12/1995 | Hoffman | 312/334.11 |
| 5,570,943 | 11/1996 | Schroder et al. | 312/334.11 |
| 5,775,788 | 7/1998 | Sasse et al. | 312/334.38 |
| 5,895,101 | 4/1999 | Cabrales | 312/334.11 |

FOREIGN PATENT DOCUMENTS

| | | | |
|---|---|---|---|
| 3323195 | 1/1985 | Germany | 312/334.33 |
| 3535332 | 4/1987 | Germany | 312/334.33 |
| 2061705 | 5/1981 | United Kingdom | 312/334.33 |

*Primary Examiner*—Janet M. Wilkens
*Assistant Examiner*—Michael J. Fisher
*Attorney, Agent, or Firm*—Henry M. Feiereisen

[57] ABSTRACT

A drawer slide assembly, includes a first slide member securable to an article of furniture, a second slide member securable to a drawer, an intermediate slide member having an area formed with a plurality of raceways, and a plurality of rolling elements received in the raceways for slidingly coupling the second and intermediate slide members. In order to significantly improve a lateral stability of the drawer slide and to reduce the elastic deformation in the area of the race ways when subject to stress, the raceways-forming area of the intermediate slide member has a groove which is open towards the outside for receiving an inwardly bent end arm of the intermediate slide member.

8 Claims, 3 Drawing Sheets

DRAWER SLIDE ASSEMBLY

CROSS-REFERENCES TO RELATED APPLICATIONS

This application claims the priority of German Patent Application, Serial No. 298 07 540.7, filed Apr. 29, 1998, the subject matter of which is incorporated herein by reference.

BACKGROUND OF THE INVENTION

The present invention relates, in general, to a drawer slide assembly, and more particularly to a drawer slide assembly of a type including an outer slide member or guide rail secured to an enclosure, such as a cabinet, case or other article of furniture, an inner slide member or runner secured to a drawer, an intermediate slide member having an area formed with a plurality of raceways, and a plurality of rolling elements, such as balls, received in the raceways for slidingly coupling the inner and intermediate slide members.

Slides for drawers are known in many designs, and include a wide range of three-part drawer slides that permit a full extension of the drawer, or two-part drawer slides that can only achieve a less than full extension of the drawer, typically three-quarters extension. The type of slide mechanism used depends, for example, on the size of the drawer and the applied loads. In a simple two-part configuration, the intermediate slide member and the outer slide member form a single rail of U-shaped cross section. In this case, each drawer slide includes a runner, with the guide rail being formed with two or three raceways for receiving the rolling elements.

In drawer slides of three-part configuration, the intermediate slide member forms a separate component so that the drawer can be fully extended from the enclosure, and both end zones of the intermediate slide member are formed with raceways, whereby both raceways-forming end zones of the intermediate slide member are in symmetry to one another. Rolling elements associated to one end travel in a respectively designed end zone of the guide rail when the drawer is moved axially in and out.

A common drawback of all drawer slide assemblies of these types is their insufficient lateral stability. Moreover, the elastic deformation in the area of the raceways is fairly high when subject to stress.

SUMMARY OF THE INVENTION

It is thus an object of the present invention to provide an improved drawer slide assembly, obviating the afore-stated drawbacks.

In particular, it is an object of the present invention to provide an improved drawer slide assembly having increased lateral stability and reduced elastic deformation in the area of the raceways.

These objects, and others which will become apparent hereinafter, are attained in accordance with the present invention by providing a first slide member securable to an article of furniture, a second slide member securable to a drawer, an intermediate slide member having an area formed with a plurality of raceways, and anti-friction bearings received in the raceways for slidingly coupling the second and intermediate slide members, wherein the raceways-forming area of the intermediate slide member has a groove which is open towards the outside for receiving a backwardly or inwardly bent end arm of the intermediate slide member.

Normally, the intermediate slide member is made through chamfering a sheet metal strip. While in conventional drawer slides, each raceways-forming area is configured in the form of a hollow body, the present invention provides for the configuration of the intermediate slide member with an end arm of sufficient length to allow a bending inwardly for projection into the groove to thereby result effectively in the creation of a massive component. As a consequence, the elasticity is significantly reduced when subject to stress, and the lateral stability of the drawer slide is greatly enhanced.

Depending on the design of the drawer slide assembly, the groove is open either in the direction of the center of the drawer or in the direction to the side wall of the article of furniture to which the outer slide member is attached. The effect of the bent end arm in conjunction with the groove can be further enhanced when supporting the free end of the bent end arm upon at least one groove boundary wall. In this manner, the bent arm is prevented from exhibiting a springy behavior.

According to another feature of the present invention, the end arm is bent backwards at an angle of approximately 180°, so that the walls of the end arm and the adjacent wall of the intermediate slide member are at least partially in flat engagement. It is suitable, however, to support the free end of the bent arm upon a lateral boundary groove wall and a boundary groove wall oriented at an angle thereto.

To better withstand applied forces, it may be advantageous when the center axis of the groove extends at an angle of approximately 45° with respect to the side wall of the article of furniture.

According to another aspect of the present invention, the configuration of the intermediate slide member allows a configuration of the runner or runners of C-shaped cross section, with the intermediate slide member being formed in the end zone or end zones with three raceways. The imaginary connecting lines of the rolling elements then describe an isosceles triangle. Suitably, the center axis of each groove extends perpendicular or substantially perpendicular to the imaginary connecting line between two opposing rolling elements to improve the securement of the outer slide member and of the runner to the drawer.

According to another feature of the present invention, the raceways-forming area of the intermediate slide member is asymmetric with respect to an imaginary connecting line between two opposing rolling elements and the center axis oriented perpendicular to the imaginary connecting line, thereby improving the resistance to lateral forces.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
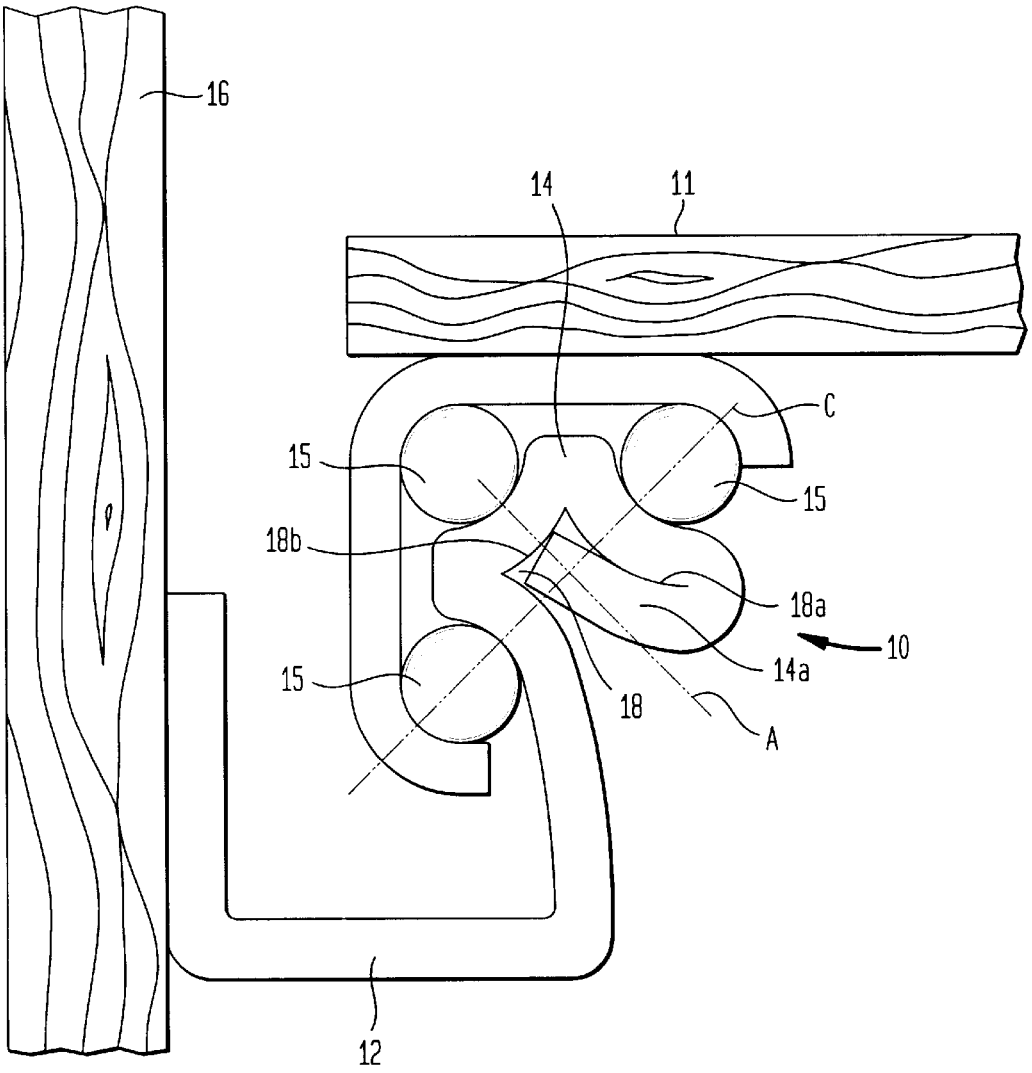
FIG. 1 is a sectional view of a first embodiment of a drawer slide assembly according to the present invention, in the form of a two-part slide that realizes only partial extension of a drawer.

Throughout all the Figures, same or corresponding elements are generally indicated by same reference numerals.

This is one of two applications both filed on the same day. Both applications deal with related inventions. They are commonly owned and have the same inventive entity. Both applications are unique, but incorporate the other by reference. Accordingly, the following U.S. patent application is hereby expressly incorporated by reference: "DRAWER SLIDE ASSEMBLY".

Turning now to the drawing, and in particular to FIG. 1, there is shown a sectional view of a first embodiment of a drawer slide assembly according to the present invention, generally designated by reference numeral 10 and provided in the form of a two-part slide mechanism that permits only partial extension of a drawer 11. For sake of simplicity, the drawer slide assembly 10 is shown only by way of a partial view. Therefore, the following description relates only to one side of the drawer slide assembly 10 for securement to the drawer 11 but persons skilled in the art will appreciate that the same parts are provided in symmetrically opposite location on the opposite side of the drawer 11, so that the drawer slide assembly 10 on both sides of the drawer 11 can be manufactured in identical form and assembled.

The drawer slide assembly 10 substantially includes an outer slide member or guide rail 12 which is secured to an interior side wall 16 of a stationary article of furniture, such as a cabinet or case, and formed in one part with an intermediate or center slide member 14, and an inner slide member or runner 13 which is of generally C-shaped configuration and affixed to an outer surface of the movable drawer 11. The intermediate slide member 14 is so shaped as to form three raceways, with each raceway receiving a series of successive rolling elements 15 in the form of balls.

As stated above, the drawer slide assembly 10 of FIG. 1 is of two-part configuration, i.e. the outer slide member 12 and the intermediate slide member 14 are of single-piece structure so that the drawer 11 cannot fully pulled out of the article of furniture. The outer slide member 12 has an angled shape for permitting threaded engagement to the side wall 16 of the article of furniture.

Figure 2:
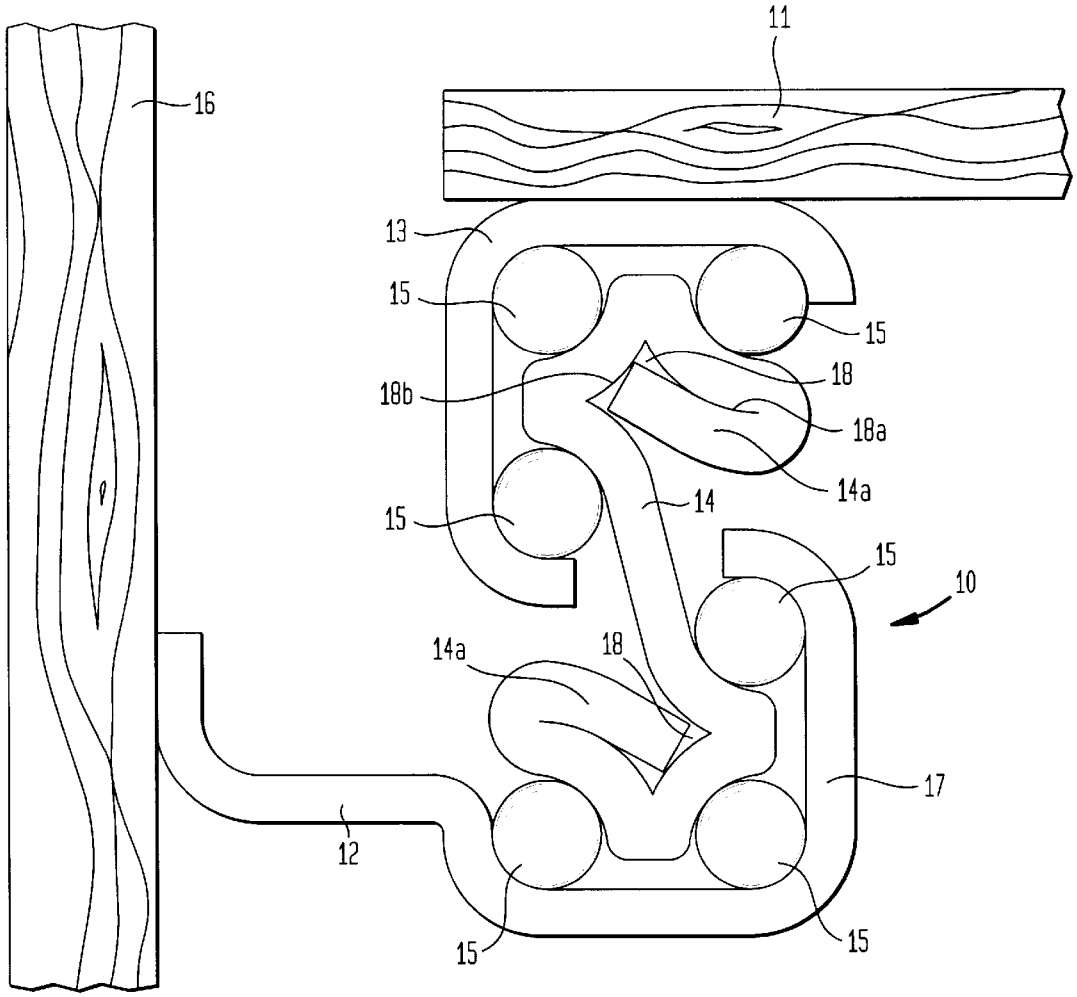
FIG. 2 is a sectional view of a second embodiment of a drawer slide assembly according to the present invention, in the form of a three part slide that realizes full extension of a drawer.

Unlike the two-part drawer slide shown in FIG. 1, FIG. 2 shows a three-part drawer slide which permits full outward extension of the drawer 11 from an article of furniture, and includes in addition to the runner 13, which is secured to the drawer 11, a lower runner 17 which is of generally C-shaped configuration. The lower runner 17 is not affixed to the drawer 11 and in single-piece configuration with the outer slide member 12. Each end zone of the intermediate slide member 14 is formed with three raceways for receiving the rolling elements 15. As seen from FIG. 2, both end zones of the intermediate slide member 14 are asymmetrical.

Figure 3:
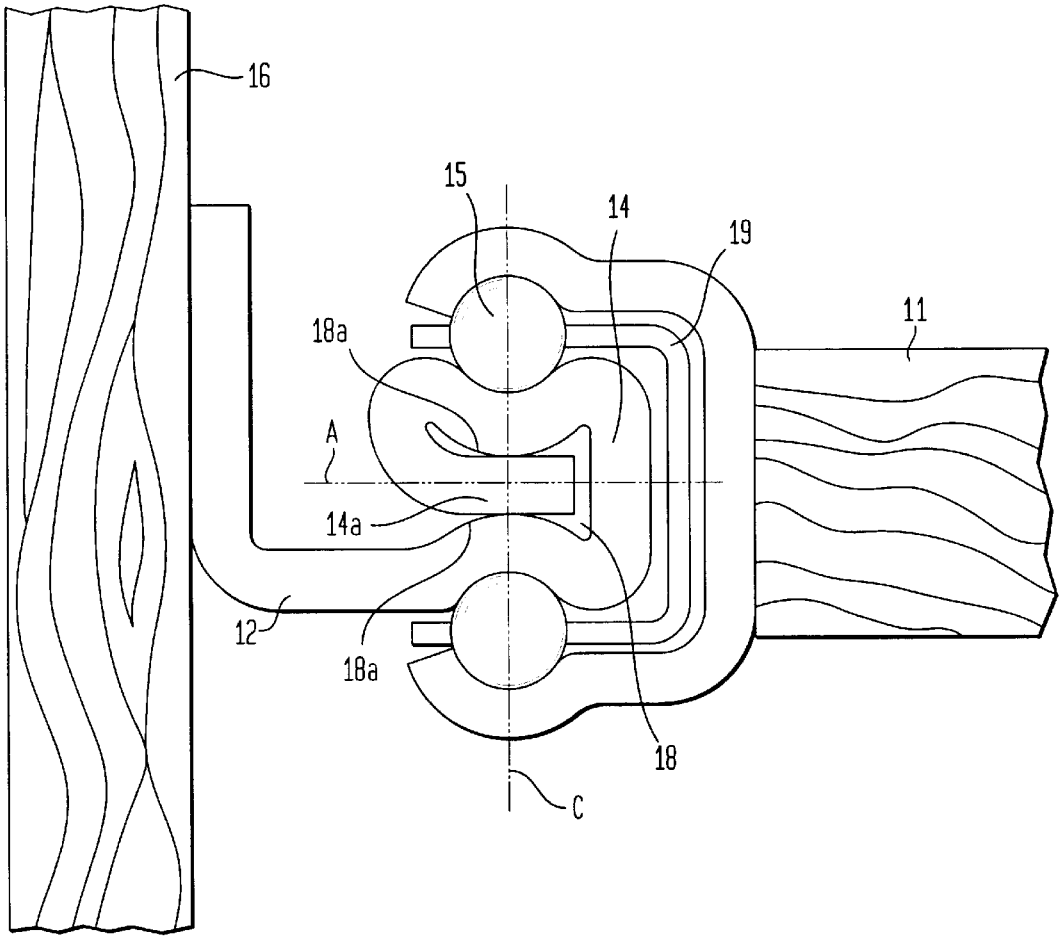
FIG. 3 is a sectional view of a third embodiment of a drawer slide assembly according to the present invention, in the form of a two-part slide similar to FIG. 1 but with an intermediate slide member having two raceways.

FIG. 3 shows a two-part drawer slide similar to FIG. 1, with the difference being that the intermediate slide member 14, which is in single-piece configuration with the outer slide member 12, has an arched shape at its free ends to define two raceways in opposite disposition for receiving the rolling elements 15 which are supported by a cage 19.

Common to all three embodiments is the novel and inventive configuration of the intermediate slide member 14 in the area of the raceways. As can be seen from FIGS. 1 to 3, the intermediate slide member 14 is generally shaped in the form of a V so as to define an outwardly open groove 18, wherein one shank of the V is prolonged outwards to form an end arm 14*a* which is bent backwards or inwardly by an angle of about 180° to project into the groove 18 and thereby substantially fill out the groove 18. Thus, unlike conventional designs, the raceways-forming area of the intermediate slide member 14 is not configured as a hollow body as a consequence of the inwardly bent end arm 14*a*.

The end arm 14*a* is supported by two boundary walls of the groove 18. In the embodiment of FIGS. 1 and 2, the end arm 14*a* is supported by a lateral boundary wall 18*a* and the central boundary wall 18*b*, while in the embodiment of FIG. 3, the end arm 14*a* is supported by opposing lateral boundary walls 18*a*. FIGS. 1 to 3 also show that, depending on the configuration of the drawer slide assembly 10, the groove 18 is open toward the side wall 16 of the article of furniture, or facing away from the side wall 16.

As further shown in FIGS. 1 to 3, the groove 18 is defined by a longitudinal center axis A which is oriented perpendicular or substantially perpendicular to an imaginary connecting line C between two opposite rolling elements 15, i.e. in FIGS. 1 and 2, the rolling elements 15 disposed at the extreme edges of the runner 13 and 17. The raceways-forming area of the intermediate slide member 14 is asymmetrical in all embodiments. This is also true for the embodiment of FIG. 3 when selecting the imaginary connecting line C between the rolling elements 15 as reference axis. Also in the embodiments of FIGS. 1 and 2, the raceways-forming area of the intermediate slide member 14 is asymmetric to any of two reference axes which are perpendicular to one another. Normally, these reference axes are those axes which extend midway between the rolling elements 15 and extend perpendicular to the imaginary connecting lines C of the rolling elements 15.

While the invention has been illustrated and described as embodied in a drawer slide assembly, it is not intended to be limited to the details shown since various modifications and structural changes may be made without departing in any way from the spirit of the present invention.

What is claimed as new and desired to be protected by Letters Patent is set forth in the appended claims:

1. A drawer slide assembly, comprising:

a first slide member securable to an article of furniture;

a second slide member securable to a drawer;

an intermediate slide member having a section defining an area formed with a plurality of raceways and at least one end arm section; and anti-friction means received in the raceways for slidingly coupling the second and intermediate slide members;

said raceways-forming area section of the intermediate slide member defining a groove which is open towards the outside adapted to receive the end arm section of the intermediate slide member which is bent inwardly into the groove, such that the bent end arm substantially fills the entire groove.

2. The drawer slide assembly of claim 1 wherein the end arm section of the intermediate slide member is supported by at least one boundary wall of the groove.

3. The drawer slide assembly of claim 2 wherein the end arm section of the intermediate slide member is supported by a lateral boundary wall and a central boundary wall of the groove.

4. The drawer slide assembly of claim 2 wherein the end arm section of the intermediate slide member is supported by two lateral boundary walls of the groove.

5. The drawer slide assembly of claim 1 wherein the end arm section is bent inwardly at an angle of approximately 180°.

6. The drawer slide assembly of claim 1 wherein the first slide member is securable to a side wall of the article of furniture, said groove being defined by a center axis which extends at an angle of about 45° with respect to the portion of the first slide member securable to the side wall.

7. The drawer slide assembly of claim 1 wherein the anti-friction means includes a plurality of rolling elements, said groove being defined by a center axis which extends substantially perpendicular to an imaginary connecting line between two opposing rolling elements.

8. The drawer slide assembly of claim 1 wherein the anti-friction means includes a plurality of rolling elements, said raceways-forming area of the intermediate slide member being asymmetric with respect to an imaginary connecting line between two opposing rolling elements and a center axis oriented perpendicular to the imaginary connecting line.

* * * * *